US007251905B2

(12) United States Patent
Doh et al.

(10) Patent No.: US 7,251,905 B2
(45) Date of Patent: Aug. 7, 2007

(54) CONDENSED WATER STORING APPARATUS OF A DRYER

(75) Inventors: Young Jin Doh, Busan-Si (KR); Chang Wook Kim, Kyungsangnam-Do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/013,407

(22) Filed: Dec. 17, 2004

(65) Prior Publication Data

US 2005/0132593 A1 Jun. 23, 2005

(30) Foreign Application Priority Data

Dec. 22, 2003 (KR) ..... 10-2003-0094462
Dec. 22, 2003 (KR) ..... 10-2003-0094471
Dec. 22, 2003 (KR) ..... 10-2003-0094472
Dec. 22, 2003 (KR) ..... 10-2003-0094473

(51) Int. Cl.
*F26B 25/06* (2006.01)

(52) U.S. Cl. ..... 34/603; 34/192; 34/201; 34/73; 34/468; 62/272

(58) Field of Classification Search ..... None
See application file for complete search history.

(56) References Cited

U.S. PATENT DOCUMENTS 2,742,708 A * 4/1956 McCormick ..... 34/76
3,767,281 A * 10/1973 Adams ..... 312/265.1
4,475,359 A * 10/1984 Sano ..... 62/272
6,595,607 B2 * 7/2003 Morgan ..... 312/294

FOREIGN PATENT DOCUMENTS

GB 2115126 A * 9/1983

* cited by examiner

*Primary Examiner*—Kenneth Rinehart
(74) *Attorney, Agent, or Firm*—Birch, Stewart, Kolasch & Birch, LLP

(57) ABSTRACT

Disclosed is a drawer structure for storing condensed water generated during the drying procedure. The drawer prevents the condensed water form being leaked out of the dryer though the condensed water is fully filled in the drawer and overflowed from the drawer. Thus, a user may not throw away the condensed water whenever the laundry is dried.

27 Claims, 10 Drawing Sheets

CONDENSED WATER STORING APPARATUS OF A DRYER

BACKGROUND OF THE INVENTION

1. Field of the Invention

The present invention relates to a dryer, and more particularly to a condensed water storing apparatus of a dryer for storing the condensed water generated when a hot and humid air passing through a drying drum passes through a condenser.

2. Description of the Related Art

Generally, a drum dryer is a household appliance for drying a subject by blowing heated air generated by an electric heater or a gas burner into a drum so that moisture remained in the subject is evaporated.

In detail, the drum dryer is classified into a condensation type and a ventilation type. In more detail, the condensation drum dryer conducts the drying procedure so that the air introduced into the drying drum is not discharged out but circulated in the dryer. In addition, the ventilation drum dryer is configured so that the air introduced in the drum is discharged out after absorbing moisture from the subject.

In addition, the ventilation drum dryer is classified into a gas type and an electric type according to the kind of heater that heats air introduced into the drum. In detail, the gas dryer is configured so that a heater for heating air introduced in the drying drum has components such as a funnel, an igniter and a flame sensor, and gas is combusted in the funnel. The heat generated from the combusted gas heats the air introduced in the drying drum. In addition, the electric dryer is configured so that a heater for heating air introduced in the drying drum has a heat wire wound several times. If power is applied, the heater generates heat, and the heat generated in the heater is transferred to the air passing through the heater to heat the air at high temperature, and the heated air is introduced in the drum to dry a subject.

Meanwhile, in case of the aforementioned condensation dryer, the circulation air passing through the condenser exchanges heat with external air to generate condensed water. In addition, the generated condensed water is stored in a condensed water storing tank, and the condensed water is then discharged out by means of a pump or moved to a condensed water storing apparatus mounted in the dryer. If the condensed water storing apparatus is fully filled with the condensed water, a user directly throws the condensed water away.

Operation of the condensation dryer is well described in U.S. Pat. No. 6,769,196, filed by the applicant of this invention, so it is not described in detail here.

Here, if a user does not recognize that the condensed water storing apparatus mounted to the related art dryer is fully filled with the condensed water so that the condensed water is overflowed, the overflowed condensed water is flowed out in front of the dryer. In addition, the leaked condensed water is flowed down along a front surface of the dryer, and then wets the floor.

In addition, the condensed water storing apparatus fully filled with the condensed water may be too heavy for a weak person such as an aged person or a child to carry, so he/she may drop the condensed water storing apparatus on the floor while carrying it. Thus, there is a need for a structure that ensures a user to safely grip the condensed water storing apparatus.

SUMMARY OF THE INVENTION

The present invention is proposed to solve the requirements and problems of the prior art, and therefore an object of the invention is to provide a dryer having a condensed water storing apparatus that is capable of separately storing condensed water generated while air is passing through a condenser, and allows a user to easily detach the condensed water storing apparatus from the dryer and then throw the condensed water away when the condensed water is fully filled in the apparatus.

In addition, another object of the invention is to provide a dryer that ensures condensed water not to be flowed out though the condensed water is fully filled in a condensed water storing apparatus and overflows the apparatus.

In order to accomplish the above object, the present invention provides a condensed water storing apparatus of a dryer, which includes a cabinet configuring an appearance of the dryer; a drying drum received in the cabinet; a drawer for storing condensed water; a front cover for configuring a front surface of the drawer; a drawer body mounted at a rear of the front cover to configure a rear surface of the drawer; a combination rib integrally formed in a rear surface of the front cover so that the front cover is combined with the drawer body; and a dispenser for receiving the drawer.

In another aspect of the invention, there is provided a condensed water storing apparatus of a dryer, which includes a condenser that generates condensed water; a sump in which the condensed water generated by the condenser is stored; a drawer for storing the condensed water carried from the sump, the drawer including an overflow controller depressed a predetermined depth from an outer circumference in order to collect overflowed condensed water, and a recess for preventing the condensed water overflowed out of the overflow controller from being flowed to the front, and a dispenser for receiving the drawer.

In another aspect of the invention, there is also provided a condensed water storing apparatus of a dryer, which includes a sump for storing condensed water; a drawer to which the condensed water carried from the sump is introduced; and a dispenser depressed a predetermined depth to receive the drawer.

In still another aspect of the invention, there is provided a condensed water storing apparatus of a dryer, which includes a condensed water storing sump in which condensed water generated in a condenser is collected; a drawer for storing the condensed water carried from the condensed water storing sump; and a dispenser for receiving the drawer, the dispenser having a separation rib protruded from an inner circumference of at least one sidewall thereof.

By using the condensed water storing apparatus of a dryer according to the present invention, a user may not discharge condensed water whenever the laundry is dried.

In addition, a user may store condensed water in the condensed water storing apparatus, and then throw the condensed water at once if the condensed water is fully filled in the condensed water storing apparatus, thereby reducing unnecessary work.

Moreover, even a weak person such as an aged person or a child may easily and safely carry the condensed water storing apparatus fully filled with condensed water, so the apparatus is not dropped down and the condensed water is not flowed on the floor.

BRIEF DESCRIPTION OF THE DRAWINGS

The spirit of the invention and resultant advantages will be more clearly understood with reference to the accompanying drawings. However, the spirit of the invention is not limited to the drawings. In the drawings.

DETAILED DESCRIPTION OF THE INVENTION

Hereinafter, a specific embodiment of the present invention is described in detail with reference to the accompanying drawings. However, the spirit of the invention is not limited to the embodiment, but retrograde embodiments and other embodiments within the scope of the invention may be proposed by adding, changing or deleting any component.

Figure 1:
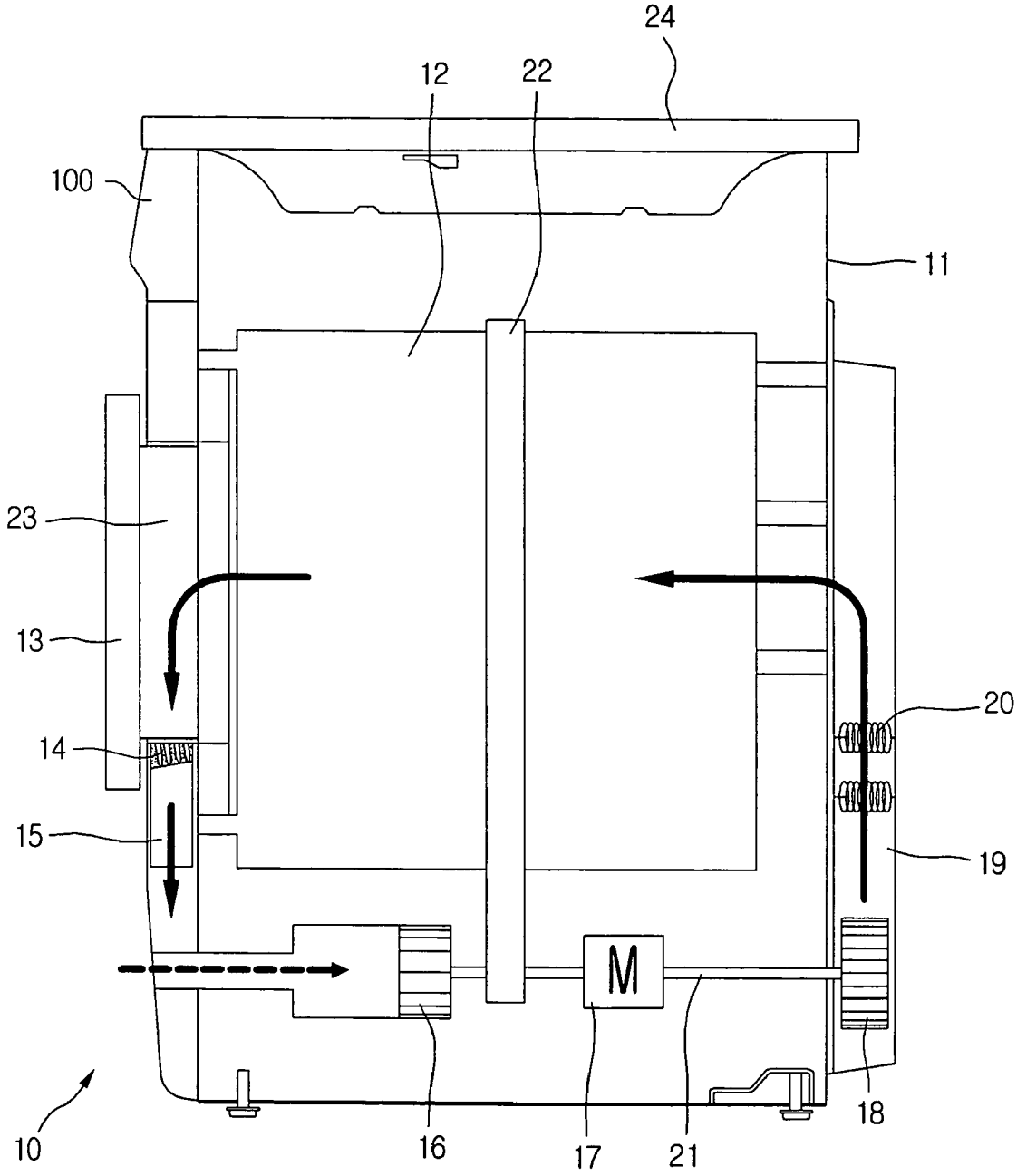
FIG. 1 is a sectional view showing a dryer having a condensed water storing apparatus according to the spirit of the present invention.

FIG. 1 is a sectional view showing a dryer having a condensed water storing apparatus according to the spirit of the present invention.

Referring to FIG. 1, the dryer 10 having the condensed water storing apparatus according to the present invention includes a cabinet 11 configuring an appearance of the dryer, a cylindrical drum 12 received in the cabinet 11, a top plate 24 seated on the top of the cabinet 11 to protect the dryer from a falling matter, a drawer 100 inserted to an upper portion of the front of the cabinet 11 to store condensed water generated during a drying procedure, a door 13 for controlling opening/closing of the drum 12, a door lint filter 23 mounted to the rear side of the door 13 to primarily filter impurities mixed in circulation air departing from the drum 12, and a belt 22 wound around the outer circumference of the drum 12 to rotate the drum 12.

In addition, the dryer 10 includes a motor shaft 21 connected to the belt 22 to transfer rotational force of the motor 17, a motor 17 connected to the motor shaft 21 to provide the rotational force, and a cooling fan 16 connected to the motor shaft 21 to rotate and inhale indoor air with receiving the rotational force of the motor 17.

In addition, the dryer 10 includes a drying fan 18 mounted to a position opposite to the cooling fan 16 to circulate air in the drum, and a drying duct 19 that acts as a passage for the air inhaled by the drying fan 18 to flow toward the drum and has a heater 20 mounted therein.

In addition, the dryer 10 includes a body lint filter 14 formed below the door lint filter 23 to secondarily filter impurities such as naps contained in the circulation air primarily filtered through the door lint filter 23, and a circulation duct 15 that acts as a passage for the air flowed in the body lint filter 14 to be flowed toward a condenser (not shown).

Hereinafter, operation of the dryer is described.

First, if power is applied to the dryer 10, the motor 17 rotates and the heater 20 attached in the drying duct 19 is heated at the same time. In addition, as the belt 22 connected to the motor shaft 21 is rotated, the drum 12 is rotated. In addition, a subject to be dried, which is received in the drum, is rotated together along the inner wall of the drum as the drum 12 rotates, and the subject is dropped down due to its weight when it reaches the top in the drum. Here, the subject is ascended by means of a lift (not shown) attached to the inner wall of the drum.

Meanwhile, the drying fan 18 connected to the motor shaft 21 is operated together with rotation of the motor 17, and the drying fan 18 inhales the circulation air that passes through the condenser (not shown) with moving along the circulation duct 15. In addition, the circulation air inhaled by the drying fan 18 is changed into a hot and dry state via the heater 20 with ascending along the drying duct 19. And then, the circulation air changed into a hot and dry state absorbs moisture existing in the subject with passing through the inside of the drum 12, thereby being changed into a hot and humid state.

In addition, the hot and humid air is flowed to the condenser along the circulation duct 15 after impurities are filtered through the door lint filter 23 and the body lint filter 14.

In addition, while the circulation air is circulated in the dryer 10 along the aforementioned path, the cooling fan 16 connected to the motor shaft 21 rotates to inhale the indoor air out of the dryer 10. And then, the inhaled indoor air is flowed to the condenser through the cooling fan 16.

Here, the circulation air in a hot and humid state flowed to the condenser along the circulation duct 15 and the indoor air inhaled by the cooling fan 16 and flowed to the condenser are passed through the condenser with being crossed. In addition, the hot and humid air and the indoor air just exchange heat, not being mixed due to the configuration of the condenser.

Thus, the circulation air in a hot and humid state is deprived of heat by the indoor air and changed into a cool and humid air. In addition, as temperature is lowered, moisture contained in the circulation air is condensed, and the condensed moisture is dropped down onto the bottom of the condenser. The condensed water collected on the bottom of the condenser is flowed to a condensed water storing sump (not shown) depressed in one side of a base (not shown) of the dryer 10. In addition, the condensed water flowed to the condensed water storing sump is pumped by means of a pump and then flowed to the drawer 100.

Meanwhile, the indoor air passing through the condenser receives heat from the hot and humid circulation air and is then changed into a hot state.

Figure 2:
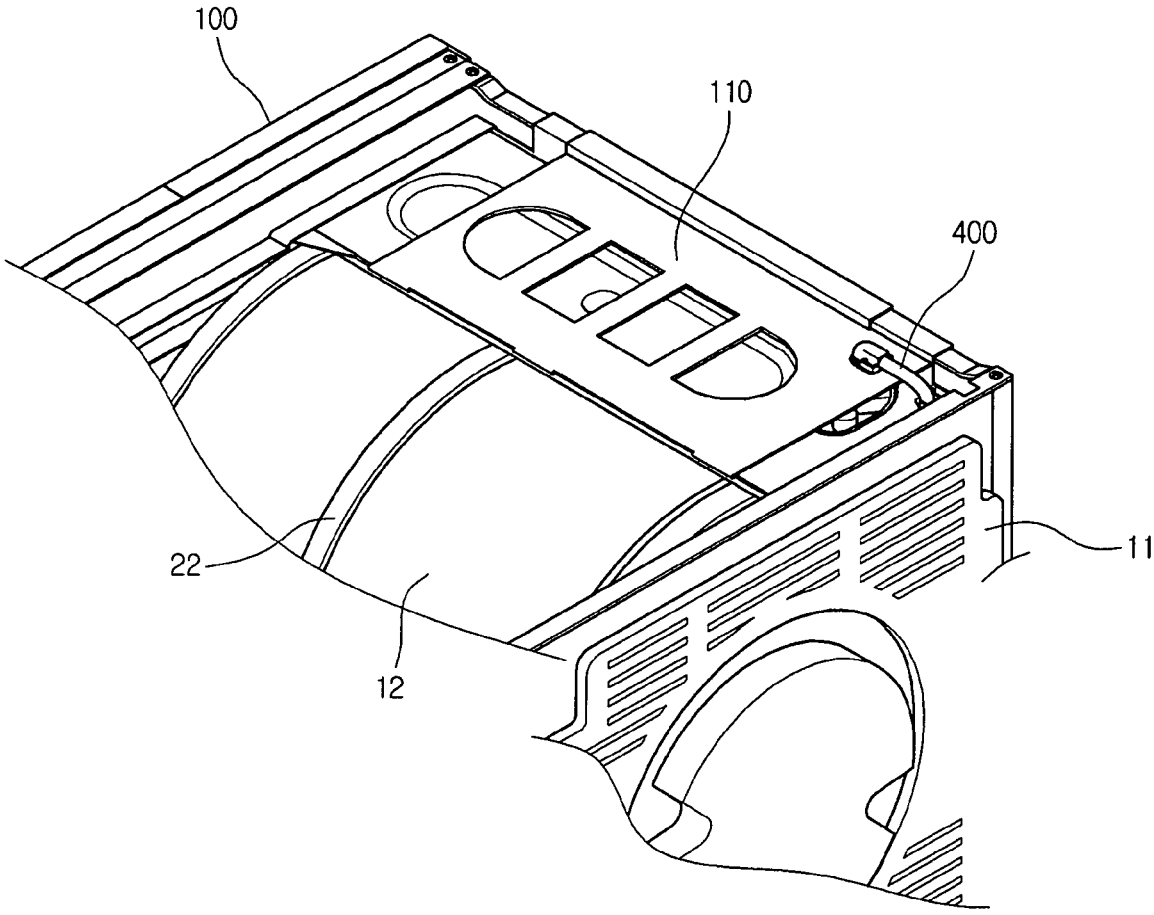
FIG. 2 is a perspective view schematically showing a dryer equipped with a drawer for storing condensed water according to the spirit of the present invention.

FIG. 2 is a partial perspective view schematically showing the dryer equipped with the drawer for storing condensed water according to the spirit of the present invention.

Referring to FIG. 2, the drawer 100 for storing condensed water according to the present invention is positioned to one side of the upper portion of the dryer, and preferably positioned in a space between the cabinet 11 and the drum 12 in which the laundry is received. In addition, the drawer 100 is protected by a drawer protecting plate 110 that covers the upper portion of the drawer 100. In addition, the condensed water generated by the condenser positioned in a lower portion of the dryer 10 is collected in the condensed water storing sump positioned in a lower surface of the dryer 10. In addition, the condensed water collected in the sump is pumped by means of the pump. In addition, the pumped condensed water is flowed to the drawer 100 along a condensed water pipe 400 that connects the drawer 100 and the sump.

Figure 3:
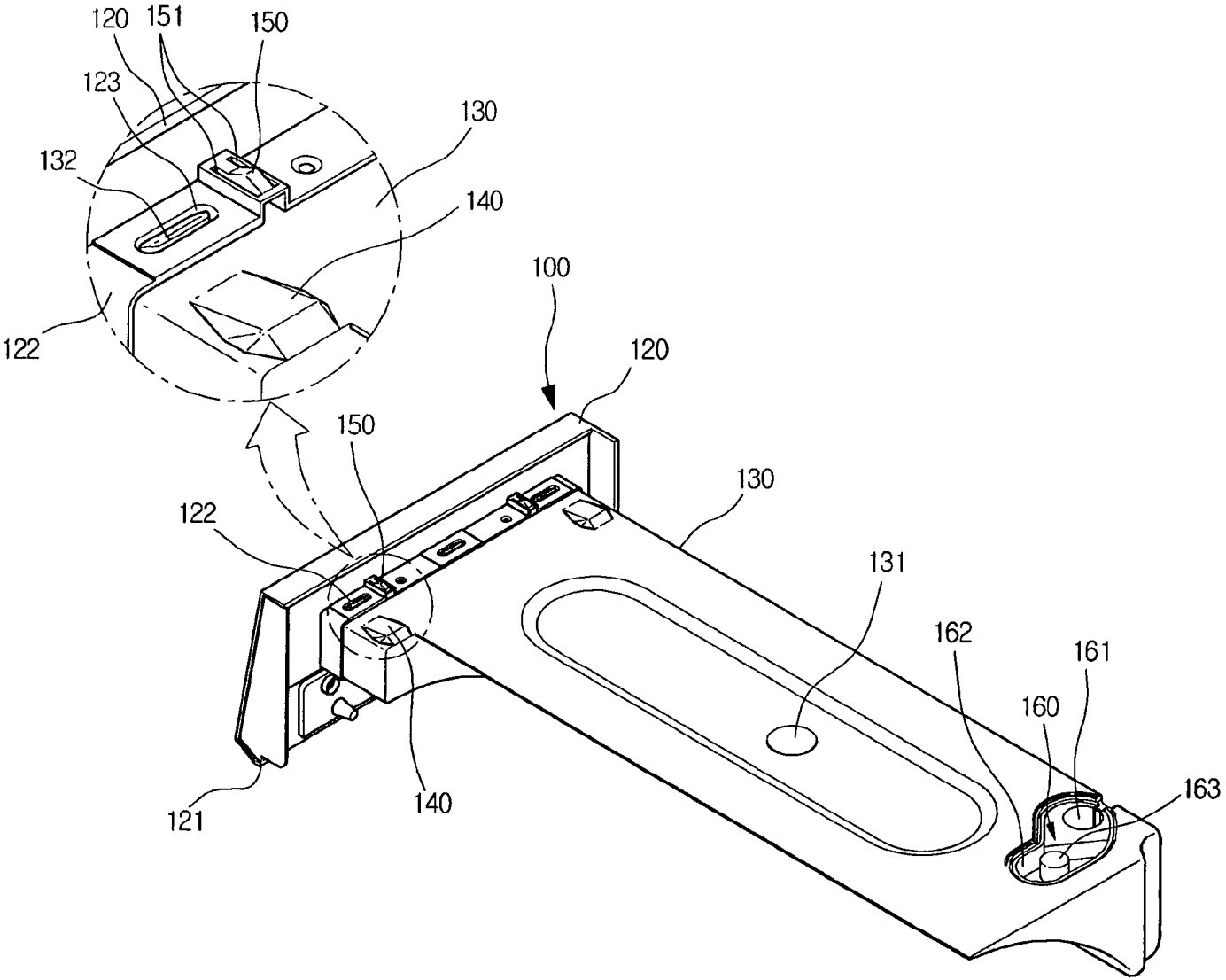
FIG. 3 is a perspective front view showing the condensed water storing drawer according to the spirit of the present invention.
Figure 4:
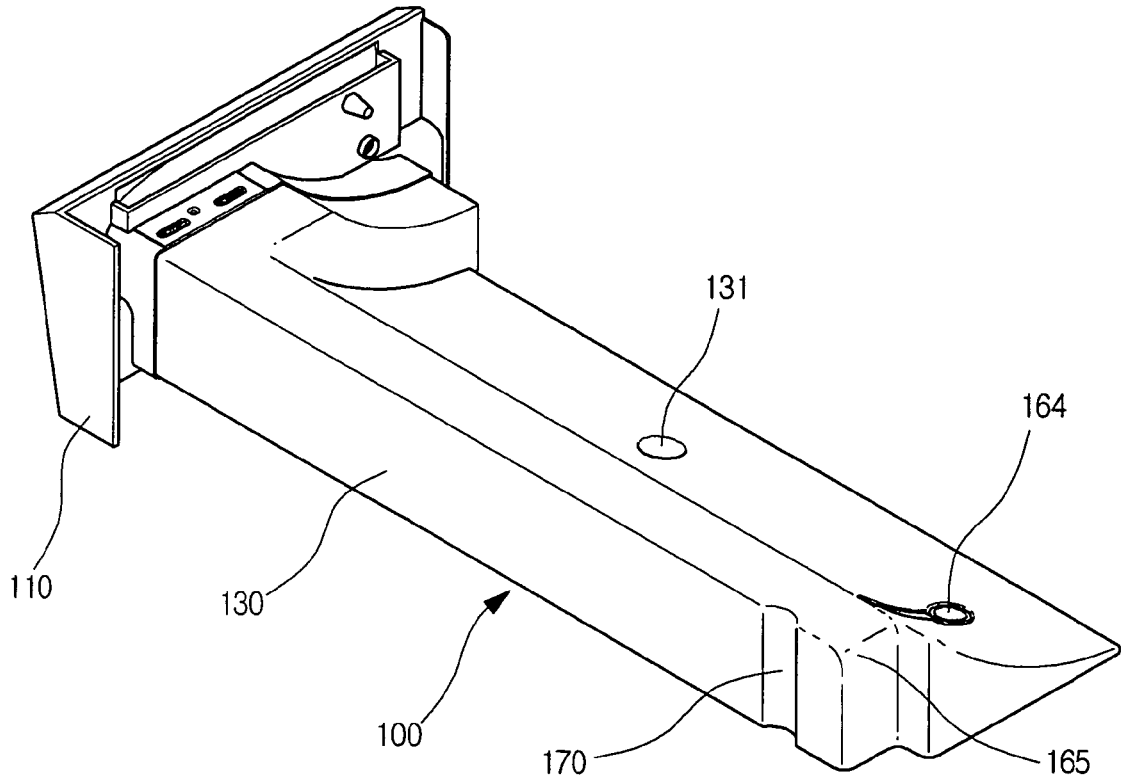
FIG. 4 is a perspective bottom view showing the drawer of FIG. 3.
Figure 5:
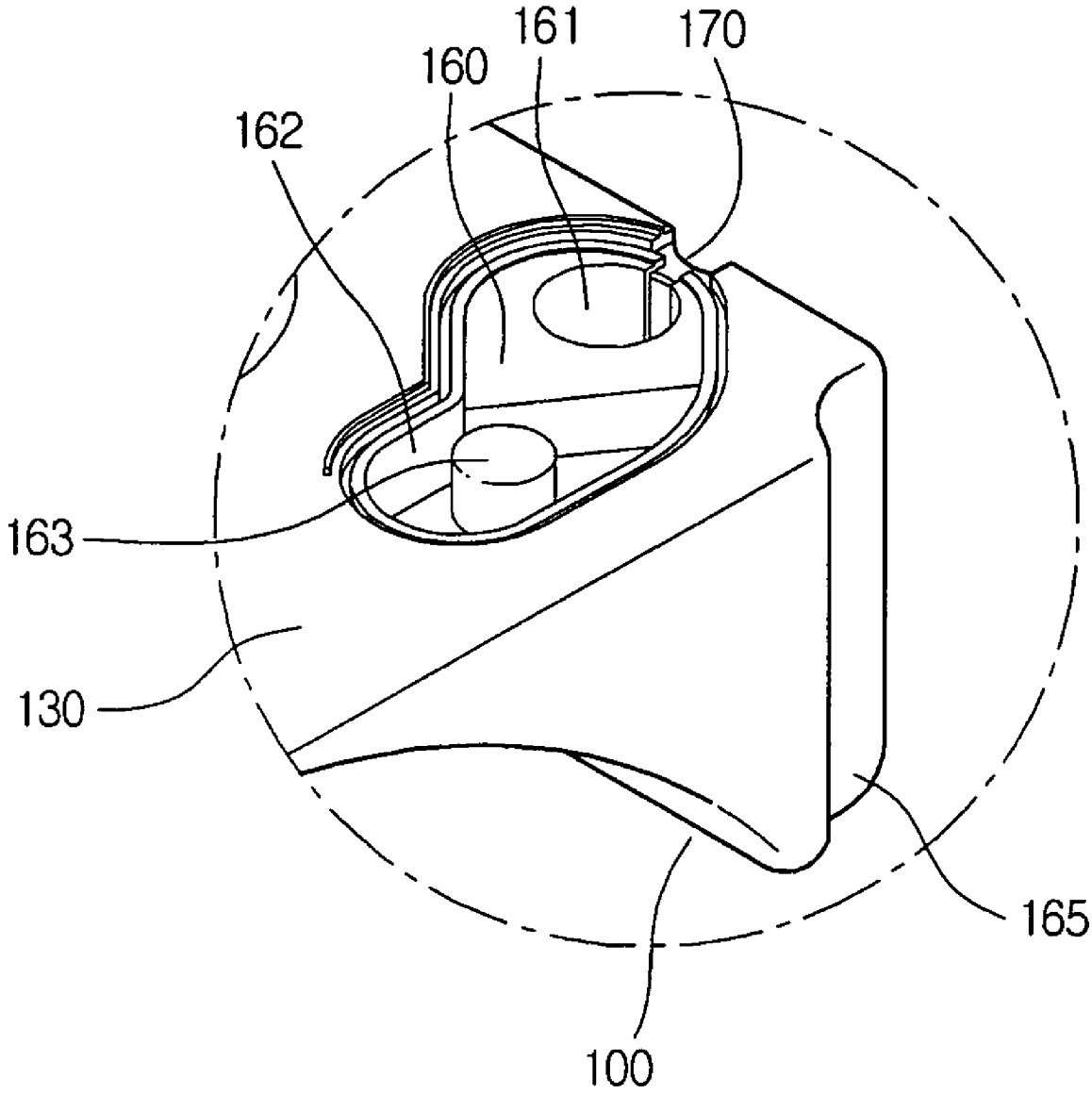
FIG. 5 is an enlarged perspective view showing an overflow controller installed to an end of the drawer.

FIG. 3 is a perspective front view showing the condensed water storing drawer according to the spirit of the present invention, FIG. 4 is a perspective bottom view showing the drawer, and FIG. 5 is an enlarged perspective view showing an overflow controller formed at an end of the drawer.

Referring to FIGS. 3 to 5, the condensed water storing drawer 100 according to the present invention includes a front cover 120 configuring a front portion, and a drawer body 130 elongated from a rear side of the front cover 120 and having a condensed water storing chamber formed therein.

In detail, the front cover 120 is formed so that a drawer handle 121 is depressed down to a predetermined depth. In addition, the front cover 120 is wrapped with a drawer body combination rib 122 protruded a predetermined height from its rear side, and the drawer body 130 is inserted into the drawer body combination rib 122.

In more detail, the drawer body combination rib 122 has at least one locking hook 150 bent to protrude upward. Here, the locking hook 150 functions that the drawer 100 is completely adhered to the dryer and then closed. In addition, on the upper portion of the drawer body 130, at least one pressing protrusion 140 is formed so that the drawer 100 is not interfered with the top plate 24 of the dryer while being inserted into the dryer.

Meanwhile, the pressing protrusion 140 is preferably inclined gently inclined as much as a predetermined angle so that the pressing protrusion 140 is not hooked to an upper end of a drawer insert hole in order to ensure smooth insertion and extraction of the drawer 100.

In addition, the locking hook 150 has elastic grooves 151 formed at both sides so as to have elasticity. Thus, when the drawer 100 is pushed into the dryer, the drawer 100 is pressed down by the top plate 24 and then lifted to its initial height when being completely inserted. As a result, the locking hook 150 is lifted to its initial height, and then hooked to an upper inside of an insert hole (not shown) into which the drawer 100 is inserted. Thus, though the dryer 10 is inclined to the front, the locking hook 150 prevents the drawer 100 from being naturally detached.

In addition, since the pressing protrusion 140 is configured so that its substantial center is raised up, the drawer 100 is pressed down when the drawer 100 is inserted or extracted. Thus, the upper surface of the front cover 120 is not interfered with the lower portion of the top plate 24.

Here, the pressing protrusion 140 may be formed at an upper center or both sides of the drawer body 130, but position, shape and number of the pressing protrusion are not limited to the embodiment.

In addition, at least one combination groove 123 having predetermined width and size is formed around the drawer body combination rib 122 so that the drawer body 130 may be combined with the front cover 120. In addition, on the outer circumference of the drawer body 130 near a position inserted into the drawer body combination rib 122, a combination protrusion 132 is protruded so as to be inserted into the combination groove 123. Since the combination protrusion 132 is inserted into the combination groove 123, the drawer body 130 is not separated from the front cover 120.

Meanwhile, an overflow controller 160 connected to one end of the condensed water pipe 400 is formed at an approximate end of the upper surface of the drawer body 130. In addition, in a side surface where the overflow controller 160 is formed, a side drawer recess 170 is formed to configure a vertical groove.

In detail, the overflow controller 160 includes a condensed water falling groove 161 for receiving the condensed water fallen after flowing along the condensed water pipe 400, an overflow storage 162 for receiving the condensed water overflowed after being fully filled in the drawer 100, and a siphon generator 163 for making the overflowed condensed water be returned to the sump. According to the above configuration, the overflowed condensed water is flowed to the siphon generator 163, and then returned to the sump by means of the siphon principle.

In more detail, the siphon principle means a phenomenon that liquid is pushed up into a tube due to the atmospheric pressure applied to a higher liquid surface. By using this principle, liquid may be flowed through a tube from a higher place to a lower place without inclining a container.

Meanwhile, a bypass tube 164 is included in the bottom surface of the overflow controller 160 so as to vertically pass through the drawer body 130. The condensed water overflowed through the bypass tube 164 is flowed toward the sump.

In detail, at a substantial center portion of the drawer body 130, there are provided an elongated hole formed to pass through the drawer chamber from an upper position to a lower position, and a shape support 131 that meets the elongated hole formed to pass through the drawer chamber from the bottom surface to the upper surface but is not communicated with the elongated hole. Here, when the drawer body 130 is made using injection molding, a hollow is formed in the drawer body 130, so the upper surface and the bottom surface of the drawer body 130 may be sunk down. Thus, the shape support 131 prevents the drawer body 130 from being sunk down in order to maintain shape of the drawer body 130 during the injection molding.

In addition, the bottom surface of the drawer body 130 is curved. In detail, since the drawer 100 is positioned at a side of the outer circumference of the drum, the shape of the bottom surface of the drawer 100 is determined according to the shape of the outer circumference of the drum.

In addition, a condensed water pipe receiving curve 165 is formed at an end of the drawer body 130 so that the condensed water pipe 400 may be received therein.

Figure 6:
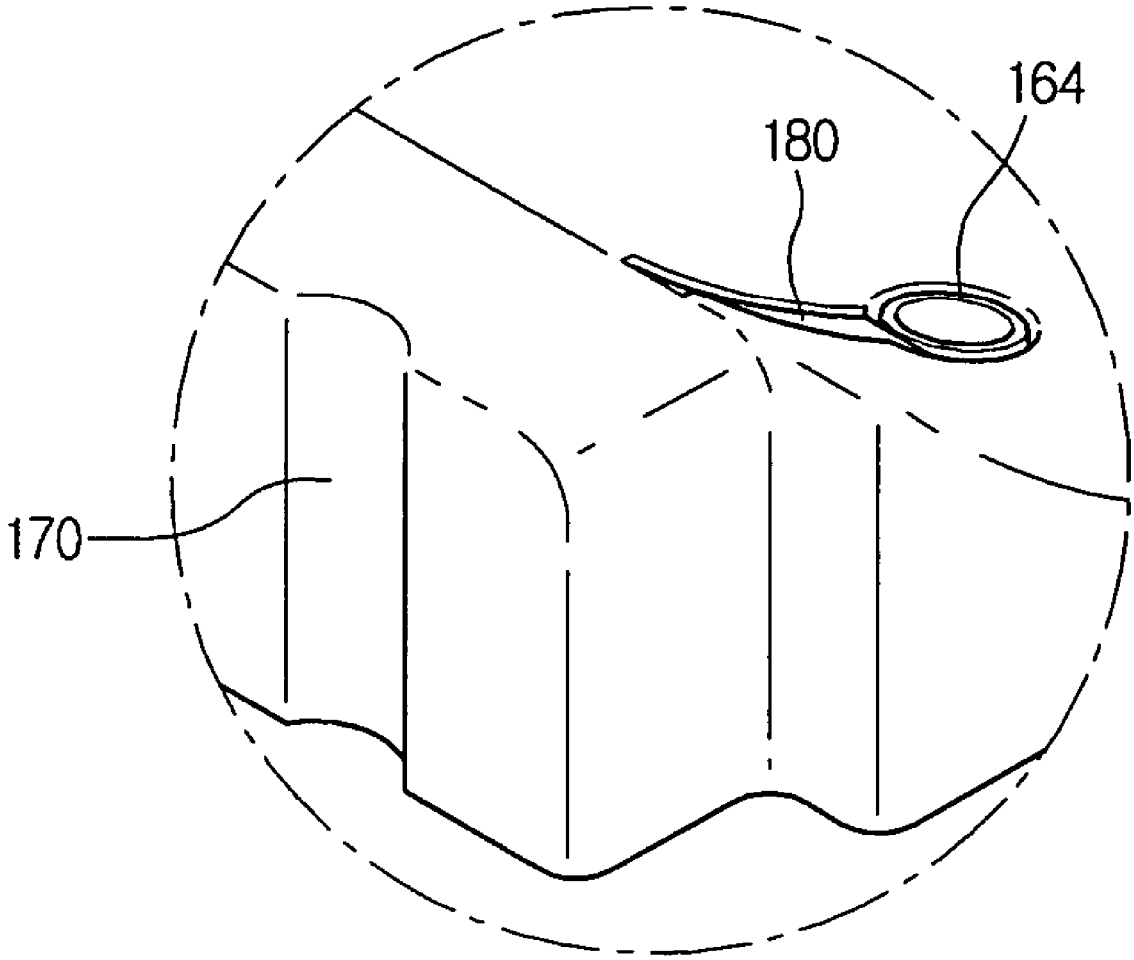
FIG. 6 is an enlarged perspective view showing a water flow preventing structure formed in a side surface of the condensed water storing drawer according to the spirit of the present invention.
Figure 7:
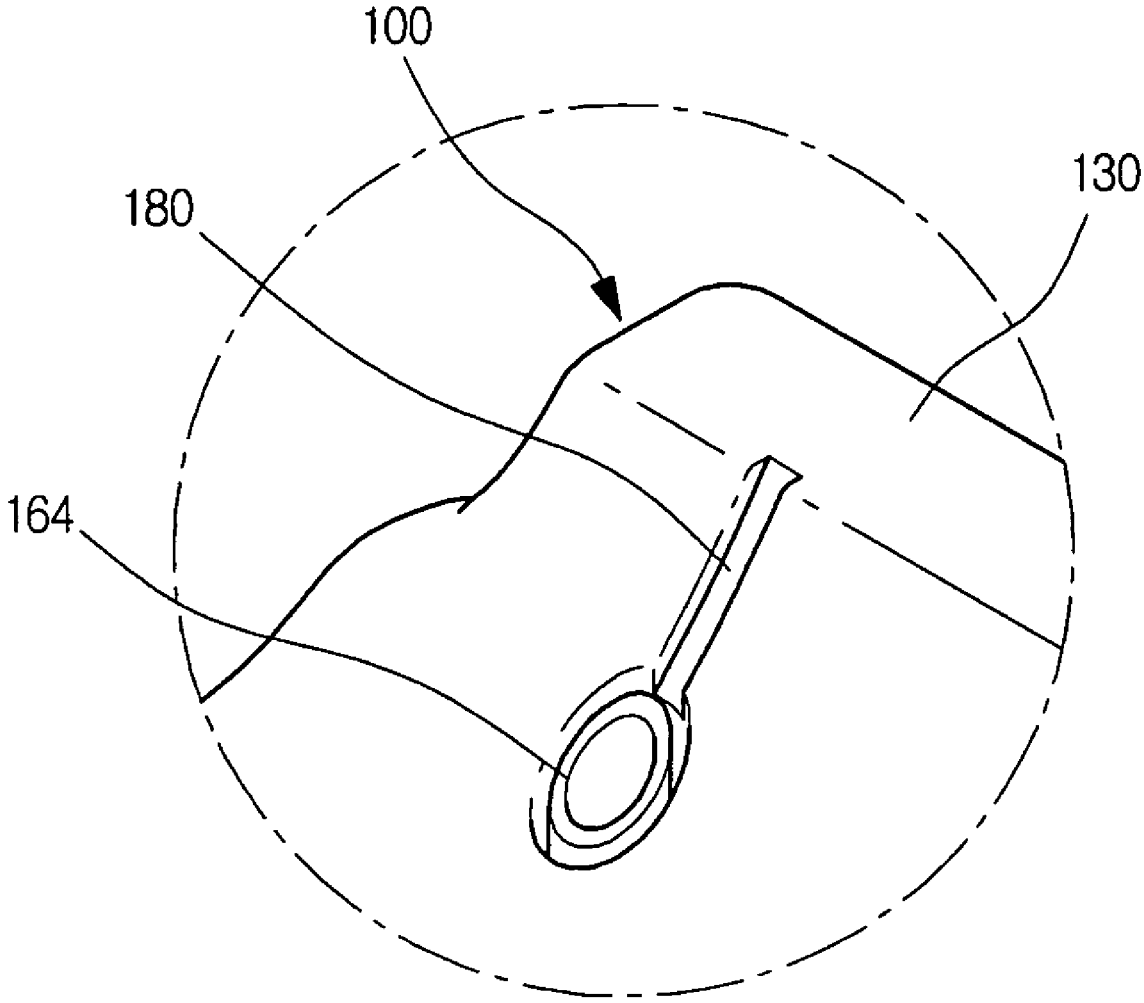
FIG. 7 is an enlarged perspective view showing a water flow preventing structure formed in a bottom surface of the drawer.

FIG. 6 is an enlarged perspective view showing a water flow preventing structure formed at a side of the condensed water storing drawer, and FIG. 7 is an enlarged perspective view showing a water flow preventing structure formed in the bottom surface of the drawer.

Referring to FIGS. 6 and 7, in case that the condensed water is fully filled in the drawer 100, the condensed water is overflowed through the condensed water falling groove 161 provided to the overflow controller 160 as mentioned above. In addition, the overflowed condensed water is collected to the overflow storage 162, and the collected condensed water is discharged through the gap formed in the bottom surface of the siphon generator 163. And then, the condensed water is returned again to the sump through the bypass tube 164 connected to the gap.

However, in case that an amount of condensed water flowed to the sump through the overflow storage 162 is greater than an amount of condensed water overflowed through the condensed water falling groove 161, the overflowed condensed water is flowed down along the outer wall of the drawer body 130.

Here, since the drawer body 130 is contacted with the inner wall of a dispenser 200 (see FIG. 8) that receives the drawer 100, the overflowed condensed water is flowed to the front of the drawer 100 along the outer circumference of the drawer body 130 and the inner circumference of the dispenser 200. In addition, the condensed water flowing to the front of the drawer 100 may be leaked out of the dryer 10.

The water flow preventing structures as shown in the figures are provided in order to solve such problem.

In detail, the side drawer recess 170 that forms a vertical groove is formed in the side surface where the overflow controller 160 is provided. Thus, the condensed water overflowed through the condensed water falling groove 161 is flowed down along the side drawer recess 170, and then fallen to the bottom surface of the dispenser 200. As a result, the overflowed condensed water is not flowed to the front of the drawer 100 along the outer circumference of the drawer body 130.

In addition, a bottom drawer recess 180 is formed in the bottom surface of the drawer 100 where the bypass tube 164 is formed, in order to form a groove in the same way along the curve of the bottom surface of the drawer.

In detail, the condensed water flowed down along the recesses 170 and 180 is collected to the bottom surface of the dispenser 200. In addition, a groove is formed in the bottom surface of the dispenser 200, and a pipe (not shown) is connected to the groove. This pipe is connected to the sump, so the overflowed condensed water is flowed again to the sump.

Figure 8:
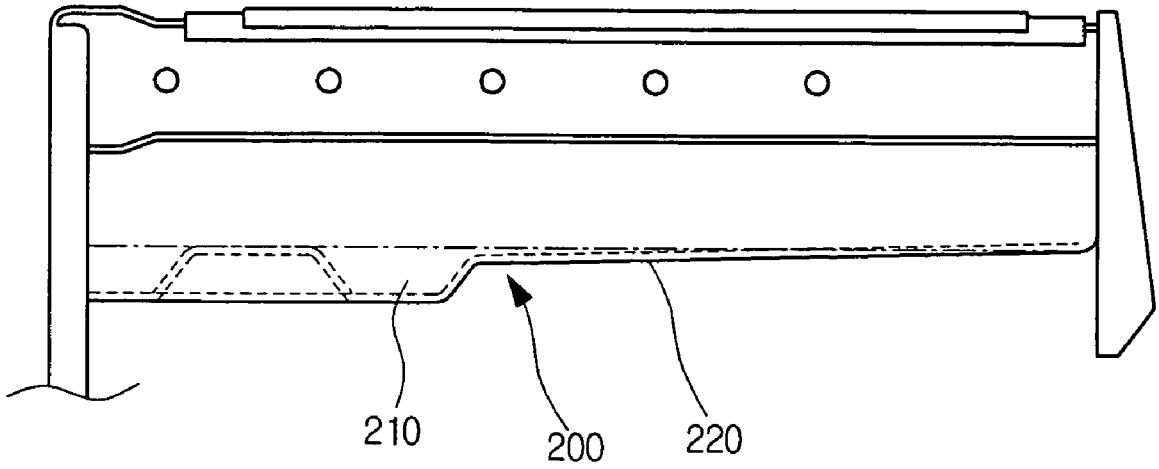
FIG. 8 is a side view showing a dispenser receiving the drawer according to the spirit of the present invention.
Figure 9:
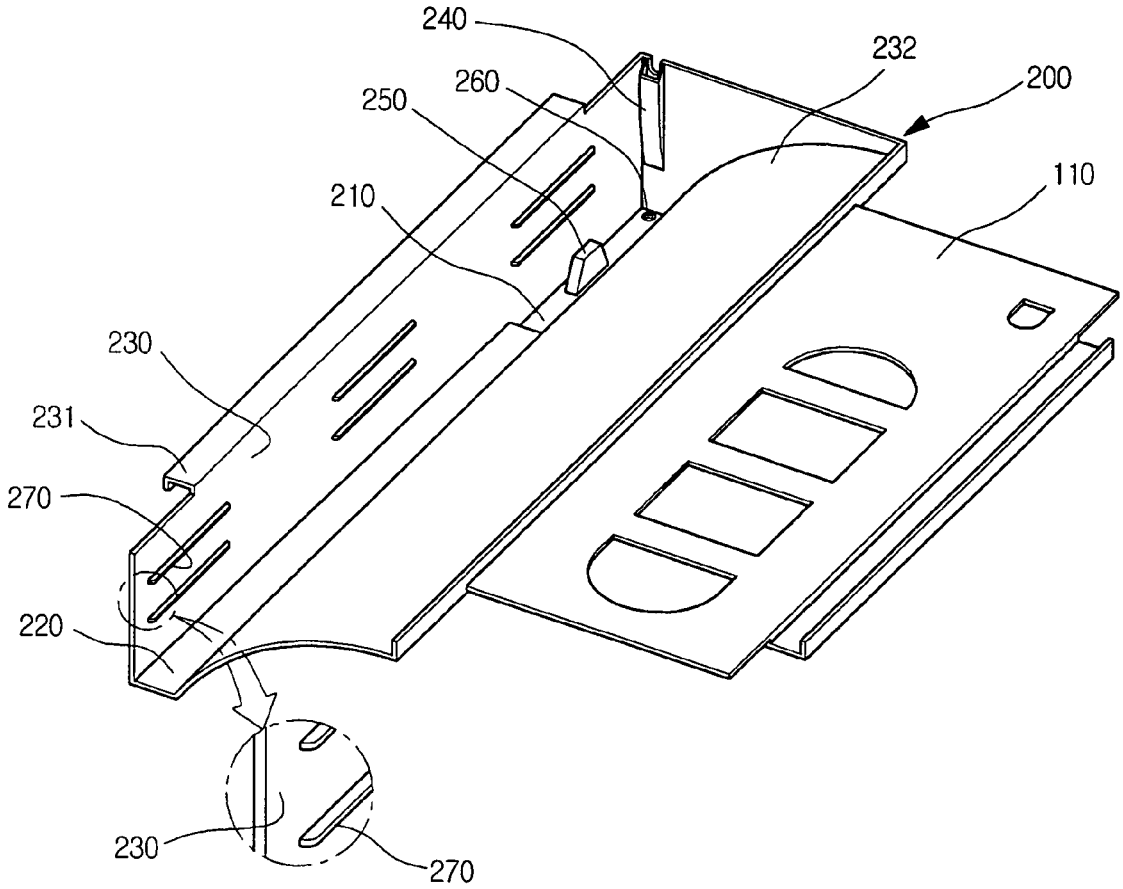
FIG. 9 is a perspective view showing inside of the dispenser.
Figure 10:
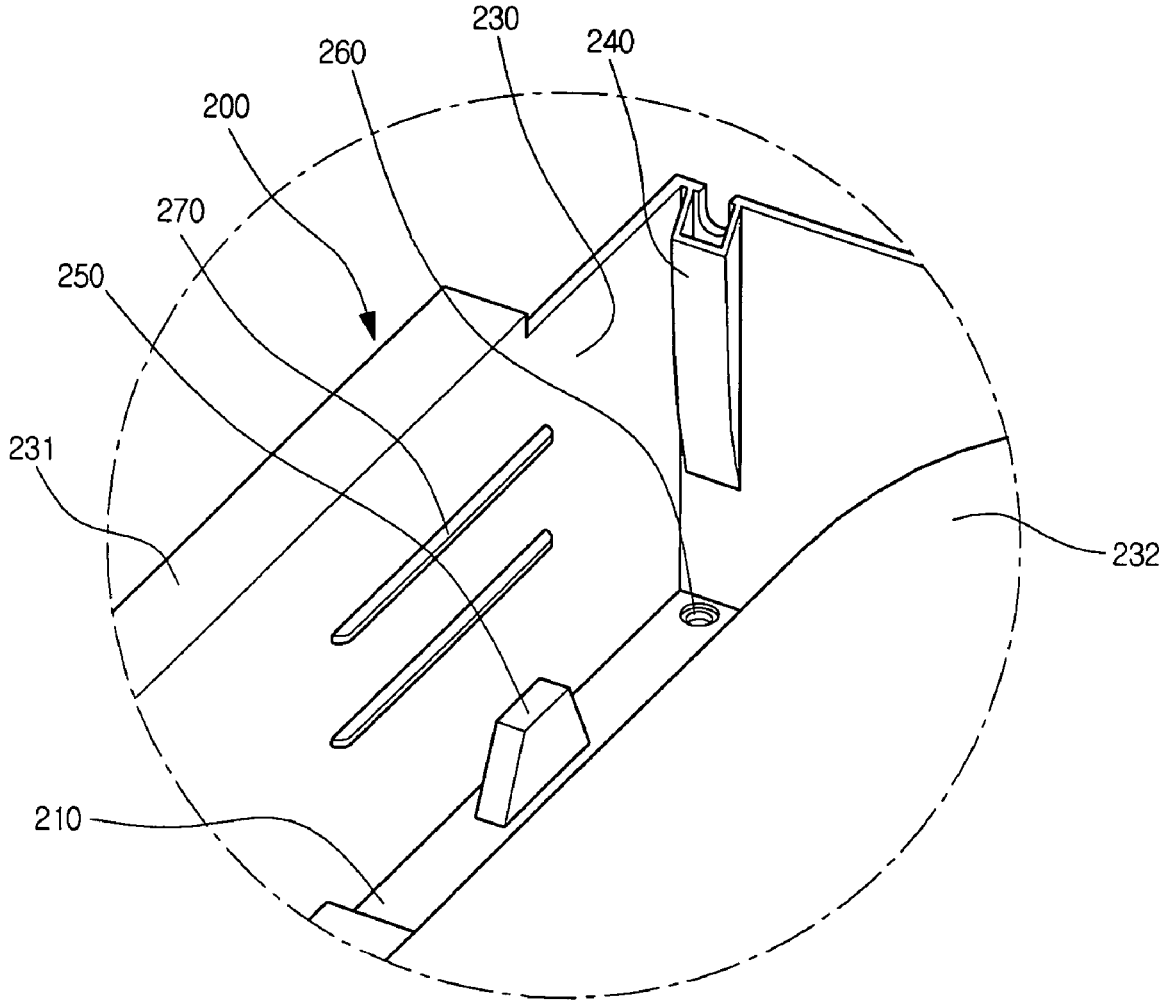
FIG. 10 is a perspective view showing a drawer insertion detecting protrusion formed in the dispenser.

FIG. 8 is a side view showing the dispenser that receives the drawer according to the spirit of the present invention, FIG. 9 is a perspective view showing inside of the dispenser, and FIG. 10 is a perspective view showing a drawer insertion detecting protrusion formed in the dispenser.

Referring to FIGS. 8 to 10, the dispenser 200 according to the present invention acts to receive the drawer 100 and includes a drawer protecting plate 110 in an upper portion to protect the drawer body 130 received in the dispenser 200. In addition, a dispenser recess 210 depressed with a predetermined depth is formed at a substantial end of the bottom surface of the dispenser 200.

In detail, since the dispenser recess 210 is formed, the condensed water overflowed from the drawer is collected. Thus, it is prevented that the overflowed condensed water is flowed to the front surface of the drawer 100 along the bottom surface of the drawer 100 and then leaked out. In addition, the bottom surface of the drawer 100 is preferably inclined slightly lower from a front portion to a rear portion. It helps the overflowed condensed water not to be flowed to the front. In addition, a condensed water discharge hole 260 with a predetermined diameter is formed in one side of the bottom surface of the dispenser recess 210 so that the condensed water stored in the dispenser recess 210 is flowed again to the sump. In addition, the sump and the condensed water discharge hole 260 are connected by means of a condensed water pipe (not shown).

Meanwhile, the inside of the dispenser 200 is formed so that its sidewall 232 contacted with the drum 12 is curved with the same curvature as that of the outer circumference of the drum 12. In addition, an opposite sidewall 230 of the dispenser 200 is formed perpendicularly, and a combination rib 231 is formed at an upper end so that the drawer protecting plate 110 is combined thereto.

In addition, the bottom surface of the dispenser 200 is composed of a dispenser inclined surface 220 inclined slightly backward as mentioned above, and a dispenser recess 210 depressed from a certain position of the dispenser inclined surface 220 to a rear end.

In detail, a drawer insertion detecting protrusion 250 is protruded on the bottom surface of the dispenser recess 210 in order to detect how much the drawer 100 is inserted. In addition, the drawer insertion detecting protrusion 250 is protruded slightly higher than the bottom surface of the dispenser at a position where the dispenser recess 210 starts. Thus, while being inserted along the bottom surface of the dispenser, the drawer 100 is hooked to the drawer insertion detecting protrusion 250. In addition, a user determines that the drawer 100 is inserted substantially to the end by recognizing that the drawer 100 is hooked to the drawer insertion detecting protrusion 250.

Meanwhile, a front surface of the drawer insertion detecting protrusion 250, that is a surface contacted with the rear end of the drawer body 130, is preferably inclined so that the drawer 100 may be softly pushed up to the upper surface of the drawer insertion protecting protrusion 250. For example, the drawer insertion detecting protrusion 250 may have a substantial trapezoidal shape, but not limited to this embodiment.

In addition, a condensed water pipe receiver 240 is protruded on the rear wall of the dispenser 200 so that the condensed water pipe 400 is received therein. In order to prevent interference with the condensed water pipe receiver 240, the condensed water pipe receiving curve 165 is formed by concavely depressing an end of the drawer 100.

In addition, the sidewalls 230 and 232 of the dispenser are contacted with the outer circumference of the drawer. Thus, in order to solve the problem that the condensed water overflowed from the drawer 100 is flowed to the front along the walls, a plurality of drawer separation ribs 270 may be formed on the sidewalls 230 and 232 so as to be elongated in front and rear direction.

In addition, the drawer separation rib 270 may be elongated in front and rear direction with a certain height, or a plurality of short ribs may also be formed at regular intervals as shown in FIG. 9. In addition, it is apparent to those skilled in the art that at least one row of such drawer separation ribs 270. In addition, a start portion of the drawer separation rib 270 is preferably rounded so that the drawer 100 may be softly inserted therein. Here, position, length and number of the drawer separation ribs 270 may be variously selected, not limited to this embodiment.

What is claimed is:

1. A condensed water storing apparatus of a dryer, comprising:

a sump for storing condensed water;

a drawer to which the condensed water carried from the sump is introduced; and a dispenser depressed a predetermined depth to receive the drawer;

wherein the dispenser has a recess depressed in the bottom surface of the dispenser as much as a predetermined depth to store the condensed water overflowed from the drawer.

2. The condensed water storing apparatus according to claim 1, wherein the bottom surface of the dispenser is inclined lower from a front portion to a rear portion.

3. The condensed water storing apparatus according to claim 1, wherein the dispenser includes a drawer insertion detecting protrusion formed on the bottom surface thereof so that a user recognizes whether the drawer is completely inserted.

4. The condensed water storing apparatus according to claim 3, wherein a front surface of the drawer insertion detecting protrusion is inclined at a predetermined angle so as to ensure soft insertion of the drawer.

5. The condensed water storing apparatus according to claim 3, wherein an upper end of the drawer insertion detecting protrusion is slightly higher than the bottom surface of the dispenser.

6. The condensed water storing apparatus according to claim 1, further comprising a condensed water discharge hole formed in a lower surface of the recess so that the condensed water stored in the recess is moved again to the sump.

7. The condensed water storing apparatus according to claim 6, further comprising a condensed water pipe for connecting the condensed water discharge hole and the sump.

8. A condensed water storing apparatus of a dryer, comprising:

a condenser that generates condensed water;

a sump in which the condensed water generated by the condenser is stored;

a drawer for storing the condensed water carried from the sump, the drawer including an overflow controller depressed a predetermined depth from an outer circumference in order to collect overflowed condensed water, and a recess for preventing the condensed water overflowed out of the overflow controller from being flowed to the front, and a dispenser for receiving the drawer.

9. The condensed water storing apparatus according to claim 8, further comprising a condensed water pipe for connecting the overflow controller and the sump.

10. The condensed water storing apparatus according to claim 8, wherein the overflow controller includes:

a condensed water falling groove for accepting the condensed water that is moved from the sump and then fallen down, and an overflow storage formed at a side of the condensed water falling groove with a predetermined depth so that the condensed water overflowed through the condensed water falling groove is collected.

11. The condensed water storing apparatus according to claim 8, wherein the overflow controller includes:

a siphon generator for carrying the condensed water overflowed from the drawer to a bottom surface of the dispenser, and a bypass tube formed in the bottom surface of the siphon generator as much as a predetermined length so that the overflowed condensed water is collected to the bottom surface of the dispenser.

12. A condensed water storing apparatus of a dryer, comprising:

a sump for storing condensed water;

a drawer to which the condensed water carried from the sump is introduced; and a dispenser depressed a predetermined depth to receive the drawer, wherein the dispenser includes:

a dispenser recess formed in the bottom surface of the dispenser with a predetermined depth so that an overflowed condensed water is collected; and a protrusion protruded a predetermined height from a bottom surface of the dispenser recess and formed to be higher than the bottom surface of the dispenser as much as a predetermined length so as to lift up an end of the drawer slightly.

13. A condensed water storing apparatus of a dryer, comprising:

a condensed water storing sump in which condensed water generated in a condenser is collected;

a drawer for storing the condensed water carried from the condensed water storing sump; and a dispenser for receiving the drawer, the dispenser having separation rib protruded from an inner circumference of at least one sidewall thereof, and wherein the separation rib is elongated from a front portion to a rear portion of the dispenser so as to prevent the condensed water overflowed from the drawer from being flowed to the front along a wall of the drawer.

14. The condensed water storing apparatus according to claim 13, wherein a front end of the separation rib is rounded so that the drawer is smoothly inserted into the dispenser.

15. The condensed water storing apparatus according to claim 13, wherein at least one row of separation ribs are formed on an inner circumference of the dispenser.

16. A condensed water storing apparatus of a dryer, comprising:

a condensed water storing sump in which condensed water generated in a condenser is collected;

a drawer for storing the condensed water carried from the condensed water storing sump; and a dispenser for receiving the drawer, the dispenser having a separation rib protruded from an inner circumference of at least one sidewall thereof, and wherein the separation rib is protruded on an inner side of the dispenser and there is formed at least one separation rib in front and rear direction at a predetermined interval to prevent an outer circumference of the drawer from contacting an inner circumference of the dispenser and the condensed water overflowed out of the drawer is thus flowed along the contact surface in front of the dispenser.

17. A condensed water storing apparatus of a dryer, comprising:

a cabinet configuring an appearance of the dryer;

a drying drum received in the cabinet; and a drawer for storing condensed water, the drawer including:

a front cover for configuring a front surface of the drawer;

a drawer body mounted at a rear of the front cover to configure a rear surface of the drawer; and a combination rib integrally formed in a rear surface of the front cover so that the front cover is combined with the drawer body, a part of the rib being inclined to a predetermined height to form at least one locking hook to keep the drawer inserted in the dispenser from being separated from the dispenser; and a condensed water dispenser for receiving the drawer.

18. The condensed water storing apparatus according to claim 1, further comprising at least one pressing protrusion protruded on an outer circumference of the drawer body to press the drawer when the drawer is inserted into the dispenser.

19. The condensed water storing apparatus according to claim 18, wherein the pressing protrusion is inclined at a predetermined angle from a front end and/or a rear end.

20. The condensed water storing apparatus according to claim 17, wherein the combination rib is extended from the rear surface of the front cover and encircled with a shape substantially identical to a section of the drawer body so as to ensure compact combination between the drawer body and the front cover.

21. The condensed water storing apparatus according to claim 17, wherein elastic grooves are formed in both sides of the locking hook so that the locking hook has elasticity.

22. The condensed water storing apparatus according to claim 17, further comprising a recessed handle in a front surface of the front cover.

23. The condensed water storing apparatus of claim 17, wherein the condensed water dispenser for receiving the drawer has separation rib means protruded from an inner circumference of at least one sidewall thereof for preventing condensed water overflowed from the drawer to flow along the at least one sidewall.

24. A condensed water storing apparatus of a dryer, comprising:

a cabinet configuring an appearance of the dryer;

a drying drum received in the cabinet;

a drawer for storing condensed water, the drawer including:

a front cover for configuring a front surface of the drawer;

a drawer body mounted at a rear of the front cover to configure a rear surface of the drawer; and a combination rib integrally formed in a rear surface of the front cover so that the front cover is combined with the drawer body; and a dispenser for receiving the drawer;

wherein at least one combining protrusion is protruded on an outer circumference of the drawer body, and an insert groove to which the combining protrusion is inserted is formed in the combination rib so as to ensure compact combination between the front cover and the drawer body.

25. A condensed water storing apparatus of a dryer, comprising:

a cabinet configuring an appearance of the dryer;

a drying drum received in the cabinet;

a drawer for storing condensed water, the drawer including:

a front cover for configuring a front surface of the drawer;

a drawer body mounted at a rear of the front cover to configure a rear surface of the drawer; and a combination rib integrally formed in a rear surface of the front cover so that the front cover is combined with the drawer body;

a dispenser for receiving the drawer; and further comprising a drawer recess depressed a predetermined depth in order to prevent the condensed water overflowed out of the drawer from being flowed to the front of the dispenser.

26. The condensed water storing apparatus according to claim 25, wherein the drawer recess includes:

a side drawer recess formed in a side surface of the drawer body; and a bottom drawer recess formed in a bottom surface of the drawer body.

27. A The condensed water storing apparatus of claim 25, wherein a bottom surface of the drawer is curved with substantially the same curvature as that of an outer circumference of the drying drum.

* * * * *